United States Patent [19]

Tsuji et al.

[11] Patent Number: 4,662,479

[45] Date of Patent: May 5, 1987

[54] OPERATING APPARATUS FOR ELEVATOR

[75] Inventors: Shintaro Tsuji, Nagoya; Yasukazu Umeda, Kasugai, both of Japan

[73] Assignee: Mitsubishi Denki Kabushiki Kaisha, Tokyo, Japan

[21] Appl. No.: 820,173

[22] Filed: Jan. 21, 1986

[30] Foreign Application Priority Data

Jan. 22, 1985 [JP] Japan ..... 60-9384
Jan. 23, 1985 [JP] Japan ..... 60-10199

[51] Int. Cl.[4] ..... B66B 1/18
[52] U.S. Cl. ..... 187/131
[58] Field of Search ..... 187/29

[56] References Cited

U.S. PATENT DOCUMENTS 3,374,864 3/1968 Port ..... 187/29 R
3,746,131 7/1973 Hirasawa et al. ..... 187/29 R
4,531,616 7/1985 Uetani et al. ..... 187/29 R
4,555,000 11/1985 Umeda ..... 187/29 R
4,558,298 12/1985 Kawai et al. ..... 187/29 R X

FOREIGN PATENT DOCUMENTS 1000878 11/1976 Canada ..... 187/29 R
57-24310 5/1982 Japan .
59-45586 1/1984 Japan .
60-40383 3/1985 Japan .

OTHER PUBLICATIONS

"Hamamatsu X-Y Tracker Two-Dimensional Strain Gauge C1055", Hamamatsu Hotonics KK, Sep. 30, 1983.

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

In an elevator having destination buttons provided on halls of a plurality of floors for appointing destination floors requested by waiting passengers, an operating apparatus for controlling operations of the elevator which is capable of tracking movement of waiting passengers that have depressed the destination buttons. Upon detecting that a passenger has gotten into the cage, only the destination call requested by this passenger is automatically registered as a cage call, whereas the destination call of a passenger not having gotten into the cage is cancelled. A destination call requested by a passenger is also cancelled under the condition that this passenger has egressed from the elevator hall.

21 Claims, 10 Drawing Figures

9B
CAGE CALL REG CKT
OPR CONT CKT
20B
21B
41B ~45B
41A ~45A
9A
CAGE CALL REG CKT
OPR CONT CKT
20A
21A
61Z
62Z
64Z
65Z
6
OUTPUT CKT
ROM
CPU
RAM
INPUT CKT
12
13
14
15
16
17
HALL CALL REG CKT
ALOT CKT
18
19
31R, 32R, 34R, 35R
34Za
35Za
32Za
31Za
3Y
DDMI (FOR BUT. DEST 5TH FL)
DDMI (FOR BUT. DEST 4TH FL)
DDMI (FOR BUT. DEST 2ND FL)
DDMI (FOR BUT. DEST 1ST FL)
35Z
34Z
32Z
31Z
3X
35B
34B
32B
31B
3P

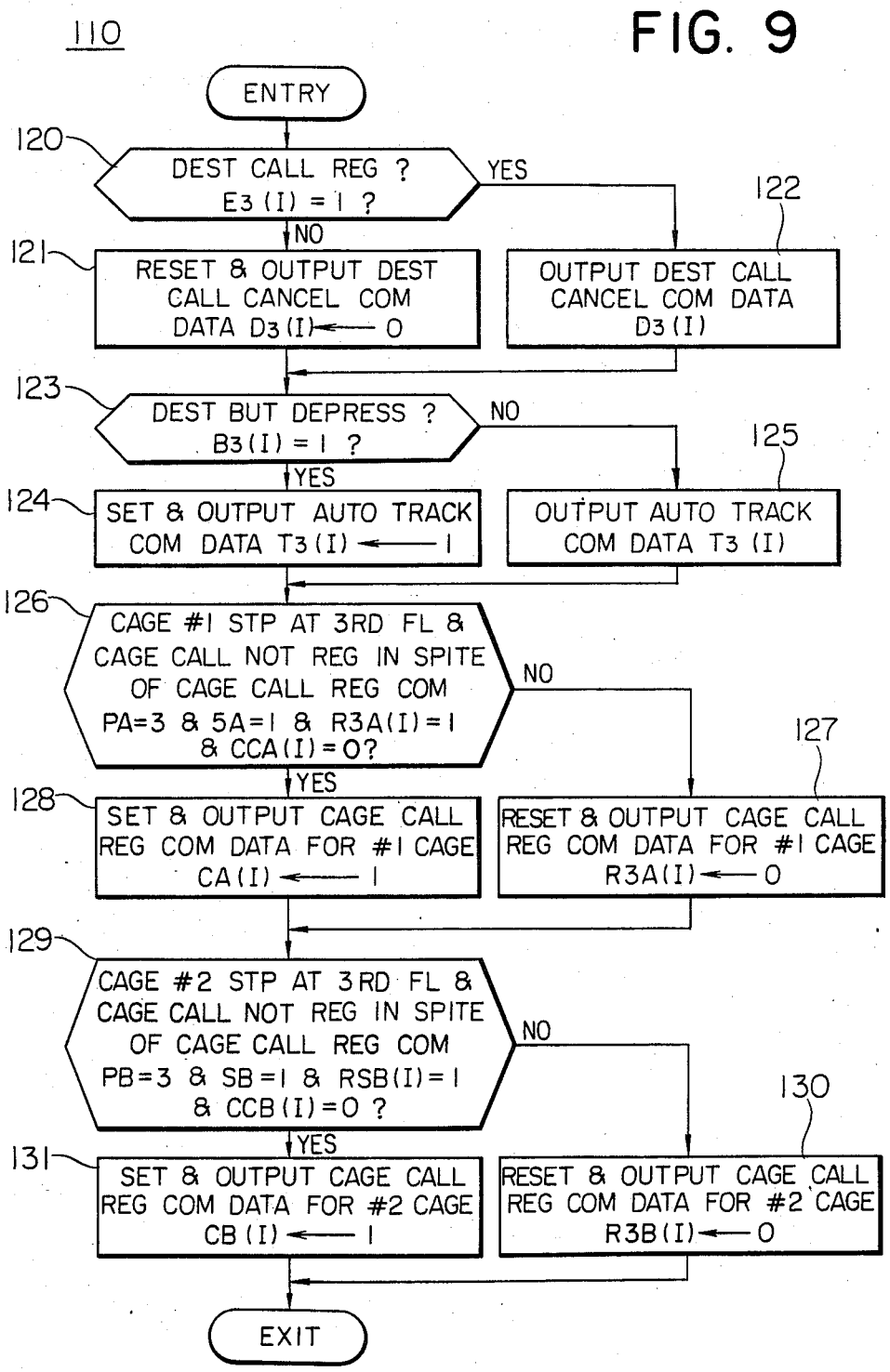
110
FIG. 9
ENTRY
120
DEST CALL REG ?
E3 (I) = 1 ?
YES
NO
121
RESET & OUTPUT DEST CALL CANCEL COM DATA D3 (I) ← 0
122
OUTPUT DEST CALL CANCEL COM DATA D3 (I)
123
DEST BUT DEPRESS ?
B3 (I) = 1 ?
NO
YES
124
SET & OUTPUT AUTO TRACK COM DATA T3 (I) ← 1
125
OUTPUT AUTO TRACK COM DATA T3 (I)
126
CAGE #1 STP AT 3RD FL & CAGE CALL NOT REG IN SPITE OF CAGE CALL REG COM
PA=3 & 5A=1 & R3A(I)=1 & CCA(I)=0?
NO
YES
127
128
SET & OUTPUT CAGE CALL REG COM DATA FOR #1 CAGE
CA (I) ← 1
RESET & OUTPUT CAGE CALL REG COM DATA FOR #1 CAGE
R3A(I) ← 0
129
CAGE #2 STP AT 3RD FL & CAGE CALL NOT REG IN SPITE OF CAGE CALL REG COM
PB=3 & SB=1 & RSB(I)=1 & CCB(I)=0 ?
NO
YES
130
131
SET & OUTPUT CAGE CALL REG COM DATA FOR #2 CAGE
CB (I) ← 1
RESET & OUTPUT CAGE CALL REG COM DATA FOR #2 CAGE
R3B(I) ← 0
EXIT

OPERATING APPARATUS FOR ELEVATOR

BACKGROUND OF THE INVENTION

This invention relates to an elevator for a building having halls which are equipped with hall buttons that simultaneously perform an operation for calling a cage and an operation for registering a destination floor aboard the cage. More particularly, it relates to improvements in an operating apparatus for an elevator in which the movement of a waiting passenger having depressed such a hall button is tracked so as to register or cancel the call made with the hall button.

Usually, an elevator is so constructed that a hall call is registered by the use of an up button or down button installed in a hall and a cage is called on the basis of the hall call. A passenger who has gotten in the cage registers a cage call by the use of a destination button installed in the cage, so as to operate the cage to a desired floor. In this manner, with the conventional elevator, the call buttons need to be respectively manipulated in the hall and the cage.

In recent years, therefore, an elevator furnished with hall destination buttons by means of which desired floors are directly registered has been proposed in, for example, the official gazette of Japanese Patent Application Publication No. 57-24310. This elevator has such advantages that a destination button need not be depressed in a cage, and that since the destination floor of a waiting passenger is known early, the group supervision performance is enhanced and the display of a waiting time becomes accurate.

However, even when the waiting passenger has depressed the up or down button or the destination button (hereinbelow, collectively termed 'hall button') in the hall, he/she may not get in the called cage by, e.g., utilizing a stairway or turning back at the recollection of another thing to do. Then, the cage having arrived undergoes a wasteful stopping operation, which may offend passengers in the cage and lengthen the waiting periods of time of other waiting passengers in the other halls.

Since some persons depress hall buttons out of mischief, the above situation is liable to occur and lowers the operating efficiency of the elevator.

In order to eliminate the drawback, an elevator described in the specification of Japanese Patent Application No. 58-147611 registers the cage call of a destination floor upon acknowledging that a waiting passenger has gotten in a cage, in such a way that increase in the output of a weighing device disposed under a cage floor is detected or that a charging device is disposed near the doorway of the cage, whereupon the interception of a light beam crossing the doorway is detected.

With the prior-art passenger detection method, for example, in a case where two or more passengers have gotten in the cage, it is impossible to detect which destination buttons the respective waiting passengers have depressed. Eventually, therefore, when any waiting passenger did not get in the cage, a cage cell is wastefully registered, and a problem similar to the foregoing still occurs.

Furthermore, as disclosed in Japanese Utility Model Application Laid-open No. 50-76563, an elevator is equipped with a waiting passenger number-detecting device in each hall. Upon detecting that, in spite of the registration of an up call or down call, there is no waiting passenger in the elevator hall, the elevator system decides that the up call or down call has been registered out of mischief, and it cancels the registration of the up call or down call.

Since, however, the waiting passenger number-detecting device detects only the number of waiting passengers in the elevator hall at the time of cage assignment, the decision of the mischievous calls is limited. By way of example, in a case where the presence of one waiting passenger at the third floor is detected and were both the up call and the down call have been registered at this time, obviously either call is the mischievous call. Nevertheless, the prior-art system cannot decide which call is the mischievous call. Eventually, a cage has been wastefully called.

Further, circumstances are similar as to the elevator whose halls are equipped with the destination buttons. Unless the situation where no waiting passengeer is in the elevator hall is established, which call is the mischievous call cannot be decided, and the lowering of the operating efficiency cannot be prevented.

SUMMARY OF THE INVENTION

This invention has been made in order to eliminate such problems, and has for its object to provide an operating apparatus for an elevator which can cancel the registration of a wasteful call to enhance the operating efficiency of the elevator.

According to the present invention in an elevator having hall control panels installed in the halls of a plurality of floors of a building and having destination buttons, the hall calls corresponding to destination floors requested by the waiting passengers are registered, so as to cause an assigned cage to respond to the hall calls and the cage calls, an operating apparatus includes decision/control means to determine the destination floors to be serviced by the assigned cage in response to movement of the passengers.

The passenger's movement is tracked by measurement means. When it has been thus detected that a passenger requesting a destination floor has gotten in the cage, any destination call registered by passengers not getting in the cage is respectively cancelled by the decision/control means, and the corresponding cage call of the destination floor appointed before getting in the cage is registered.

Furthermore, the decision/control means also determines whether or not the waiting passenger has egressed from the elevator hall, in accordance with the output of the measurement means so as to cancel the registration of halls calls requested by the waiting passenger, under at least the condition that the waiting passenger has egressed from the elevator hall.

BRIEF DESCRIPTION OF THE DRAWINGS

FIGS. 9 and 10 are flow charts each showing a subprogram in FIG. 8.

PREFERRED EMBODIMENT OF THE INVENTION

Figure 1:
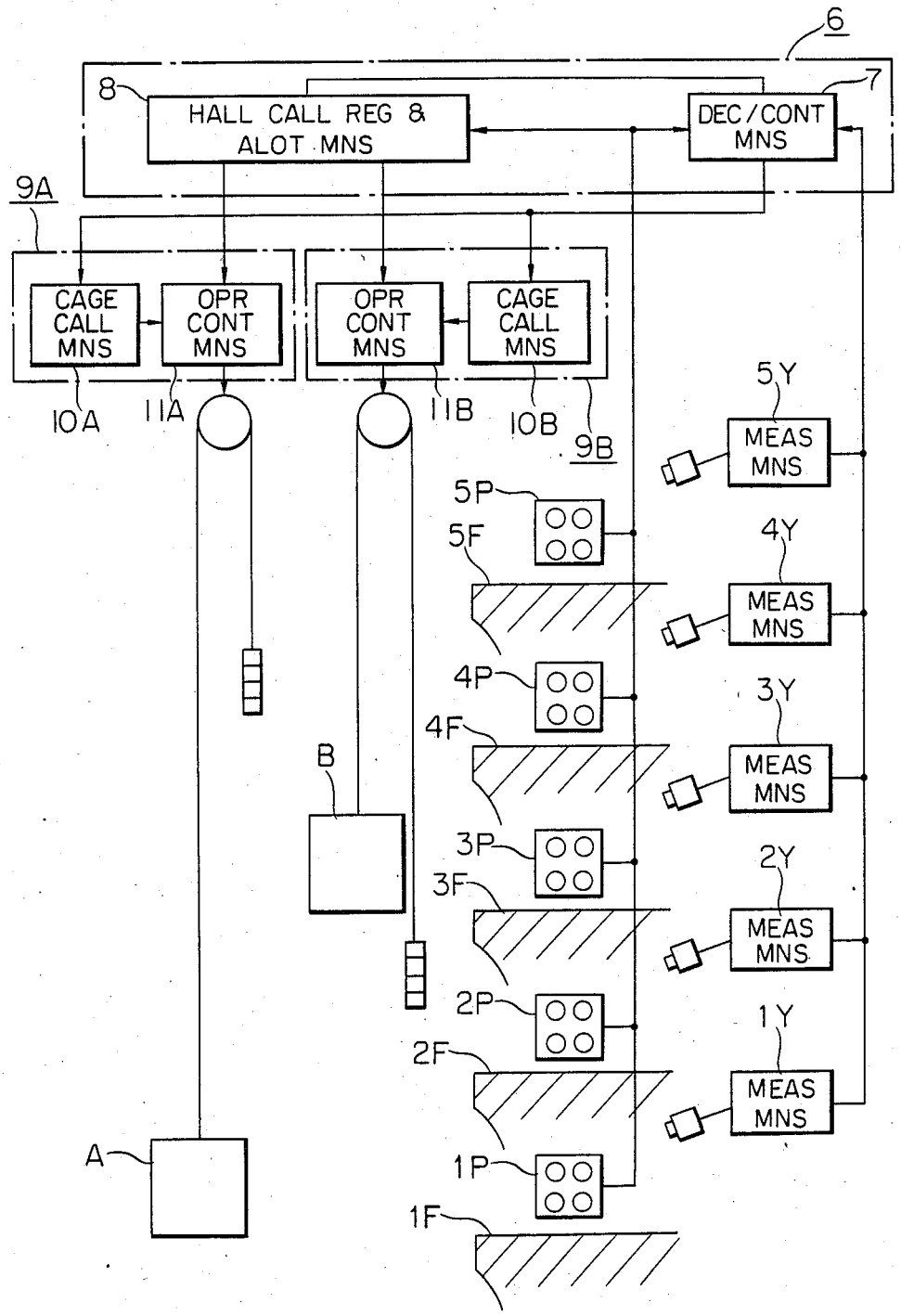
FIG. 1 is a block diagram showing the general arrangement of an embodiment of an operating apparatus for an elevator according to this invention.

Now, an embodiment of an operating apparatus for an elevator according to this invention will be described with reference to FIGS. 1–10. FIG. 1 is a general arrangement diagram for clearly illustrating the arrangement of the embodiment. In the arrangement of FIG. 1, a five-story building is furnished with two cages; cage A (=cage No. 1) and cage B (=cage No. 2). The halls of first–fifth floors 1F–5F are respectively equipped with hall control panels 1P–5P each of which has destination buttons for appointing destination floors, and measurement means 1Y–5Y to analyze the images of television cameras, thereby tracking the movements of waiting passengers in the respective halls and outputting the positions of the waiting passengers.

A group supervision device 6, which is disposed in a machinery room lying at the uppermost part of the building, is constructed of decision/control means 7 to command the cages No. 1 and No. 3 to register the cage calls of the destination floors appointed with the hall control panels 1P–5P and to decide whether or not the cage call is a wasteful call and command the cages to cancel the wasteful call, in accordance with the outputs of the measuring means 1Y–5Y, and hall call registration/allotment means 8 to register up calls and down calls for calling the cages to the halls and the destination calls for appointing the destination floors and to select the best cages for serving the hall calls (hereinbelow, the up call, the down call and the destination call shall be collectively expressed as such) and deliver assignment signals, in accordance with the manipulations of the destination buttons of the hall control panels 1P–5P at the respective floors.

Cage control devices 9A and 9B, which are similarly disposed in the machinery room, are respectively constructed of cage call registration means 10A and 10B to register the cage calls in accordance with the outputs of the decision/control means 7, and operation control means 11A and 11B to control basic operations such as the operations of opening and closing the doors of the cages, in addition to the running or stoppage of the cages and the determination of the running directions of the cages for causing the cages No. 1 and No. 2 to respond to the hall calls allotted to the cage calls.

Figure 2:
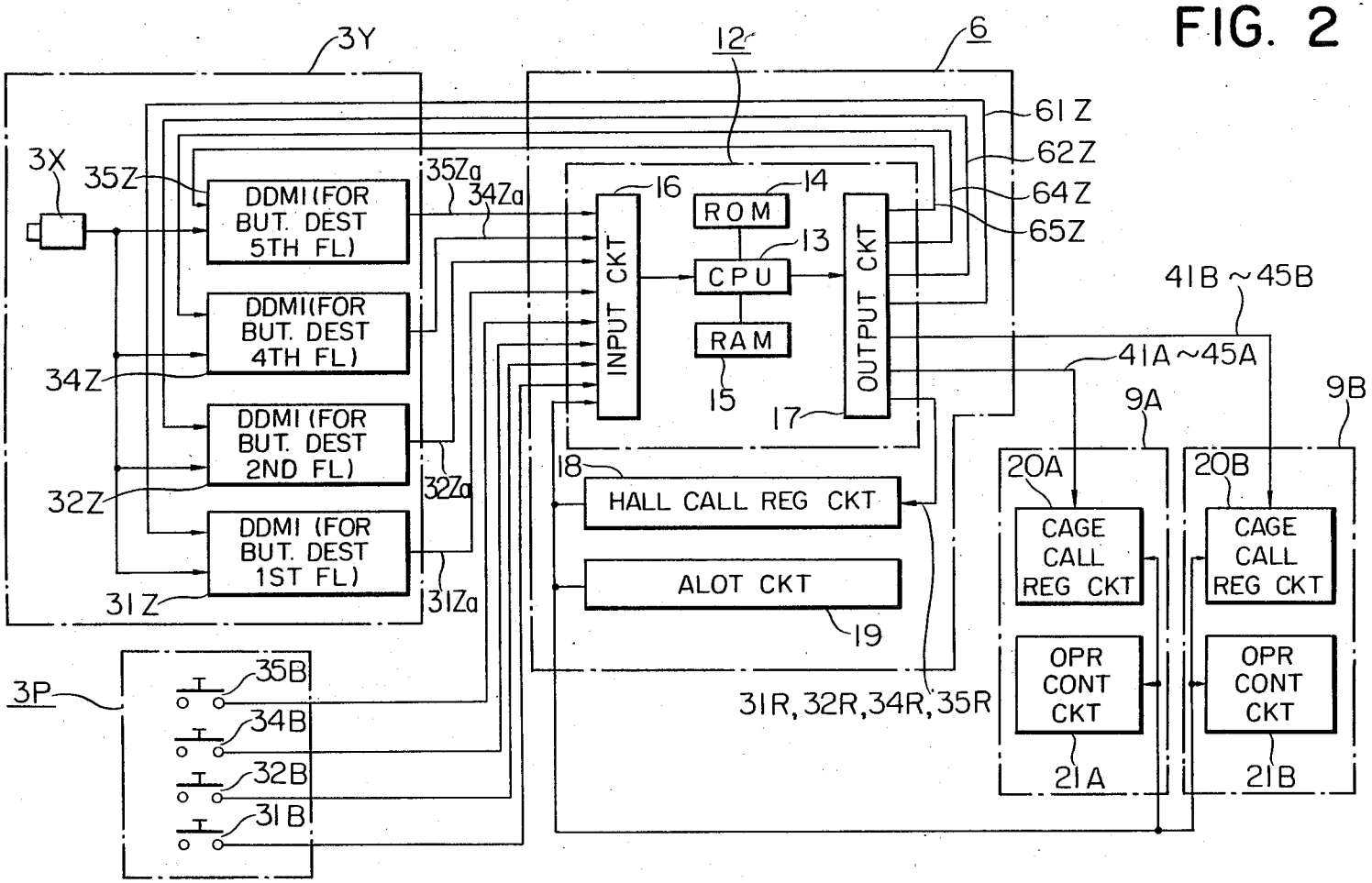
FIG. 2 is a block diagram showing a system arrangement in the elevator operating apparatus of FIG. 1.
Figure 3:
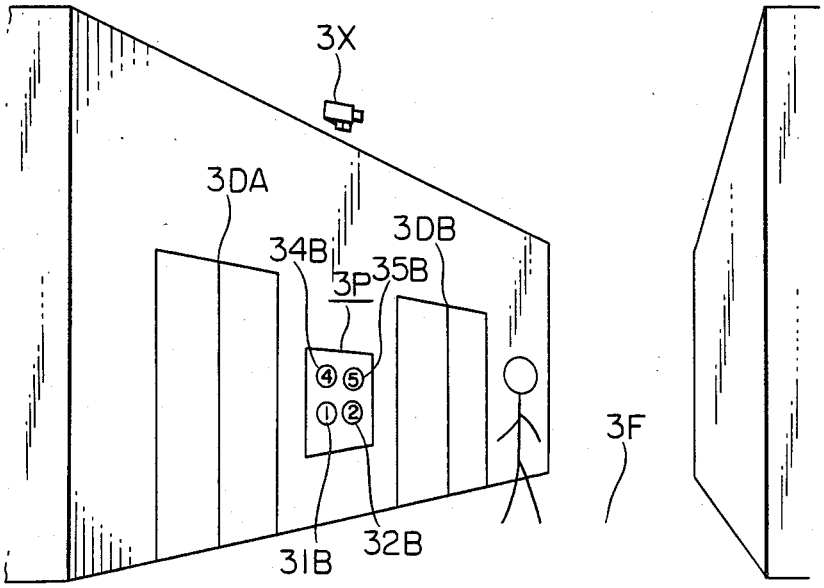
FIG. 3 is a perspective view showing the arranged position of a television camera in the elevator operating apparatus.

FIG. 2 is a system arrangement diagram of the embodiment in FIG. 1. In FIG. 2, the same portions as in FIG. 1 are assigned identical symbols. Symbol 3X denotes a television camera which is connected to the measurement means 3Y at the third floor and which is installed on the ceiling of the elevator hall of the third floor as shown in FIG. 3. Symbols 31B, 32B, 34B and 35B denote destination buttons destined for the first floor, second floor, fourth floor and fifth floor, which are disposed in the hall control panel 3P of the third floor as also shown in FIG. 3. Symbols 3DA and 3DB in FIG. 3 denote hall doors for the cages No. 1 and No. 2, respectively.

Symbols 31Z, 32Z, 34Z and 35Z indicate well-known dynamic displacement measuring instruments, which analyze an image picked up by the television camera 3X of the third floor, in a short cycle (for example, 10 times per second), to individually track the movements of the waiting passengers of the third-floor ball having depressed the destination buttons 31B, 32B, 34B and 35B destined for the first, second, fourth and fifth floors and to provide the positions of the passengers as position signals 31Z*a*, 32Z*a*, 34Z*a* and 35Z*a* taken along an X-axis and a Y-axis (to be described later), respectively.

Figure 4:
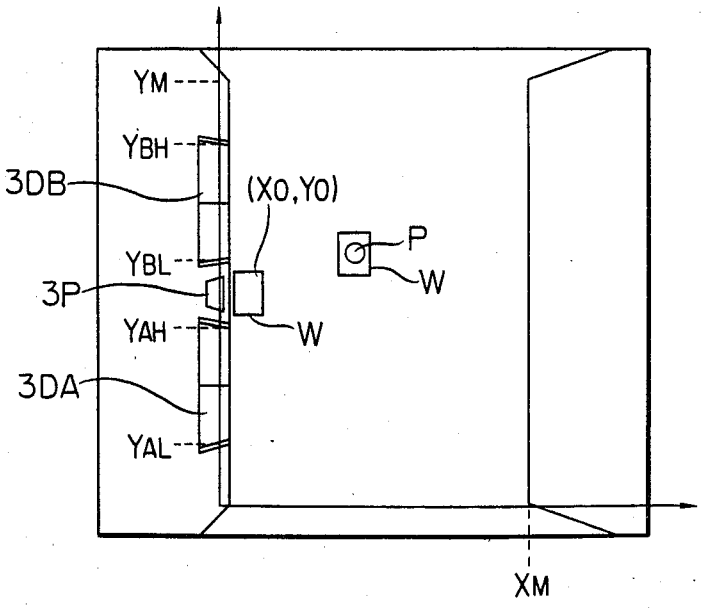
FIG. 4 is a view for explaining the functions of dynamic displacement measuring instruments in the elevator operating apparatus.

FIG. 4 shows an example of the image picked up by the television camera 3X. The X- and Y-axes and measurement starting point of the dynamical displacement measuring instruments 31Z, 32Z, 34Z and 35Z are all adjusted as shown in FIG. 4 beforehand. The X-axis is set near the doorway of the elevator hall on the side of the cage No. 1, while the Y-axis is set near the hall doorways of the cages No. 1 and No. 2. The measurement starting point is set at a position ($X_0$, $Y_0$) corresponding to the front surface of the hall control panel 3P.

Accordingly, on the X–Y coordinates, the elevator hall is expressed by a range of $0 \leqq X \leqq X_M$ and $0 \leqq Y \leqq Y_M$, and the positions of the doors of the cages No. 1 and No. 2 are respectively expressed by $X=0$ and $Y_{AL} \leqq Y \leqq Y_{AH}$, and $X=0$ and $Y_{BL} \leqq Y \leqq Y_{BH}$.

In this embodiment, the darkest spots of the image of the television camera 3X (corresponding to the heads of the waiting passengers of the hall) are detected, and the centroid positions thereof are deemed the positions P of the waiting passengers. Around the darkest spots, a window W of suitable size is set (in consideration of the size of one waiting passenger viewed from above through the television camera 3X, the size of the window W is preset to the extent of overlapping no other waiting passenger).

By setting the window W, even when there are a large number of other dark spots (corresponding to the heads of other waiting passengers), the movement of one predetermined waiting passenger can be tracked without being affected by the other dark spots.

Automatic tracking command signals 61Z, 62Z, 64Z and 65Z are respectively input to the dynamic displacement measuring instruments 31Z, 32Z, 34Z and 35Z. When the automatic tracking command signals 61Z, 62Z, 64Z and 65Z are respectively set at "H" (high level), the automatic tracking of the darkest spots in the windows W is started.

If the measuring instrument has missed the darkest spot within the window W during the automatic tracking, it continues to produce a positional data output immediately before the missing. Besides, when the automatic tracking command signals 61Z, 62Z, 64Z and 65Z are respectively reset to "L" (low level), the position P of the waiting passengers are returned to the measurement starting point ($X_0$, $Y_0$) again, and the windows W are set at the initial position accordingly.

Numeral 12 in FIG. 2 indicates a passenger action deciding device (corresponding to the decision/control means 7 in FIG. 1) which is constructed of a microcomputer disposed in the group supervision device 6, and which comprises a CPU 13, a ROM 14, a RAM 15, an input circuit 16 and as output circuit 17.

The input circuit 16 is supplied with signals from the measurement means 1Y–5Y (the measurement means 1Y, 2Y, 4Y and 5Y are not shown in FIG. 2) and hall control panels 1P–5P (the hall control panels 1P, 2P, 4P and 5P are not shown in FIG. 2) installed at the respective floors, and also signals concerning the registration state and allotment state of the hall calls and the cage state such as cage positions and directions, from a hall call registration circuit 18 (to be described later), an assignment circuit 19 (to be described later) and the cage control devices 9A, 9B.

On the other hand, the output circuit 17 supplies the automatic tracking command signals 61Z, 62Z, 64Z and 65Z for the dynamic displacement measuring instruments 31Z, 32Z, 34Z and 35Z at the third floor, as well as automatic tracking command signals for dynamic displacement measuring instruments (not shown) at the other floors, and cage call registration command signals 41A–45A which become "H" when the decision device 12 commands the cage No. 1 to register the cage calls of the first floor–fifth floor respectively, as well as similar cage call registration command signals 41B–45B for the cage No. 2.

Further, the hall call registration circuit 18 is supplied with command signals which serve to cancel the destination calls registered with the hall control panels 1P–5P. Among the command signals, those 31R, 32R, 34R and 35R are destination call cancelling command signals which become "H" when the destination calls of the third floor destined for the first floor, the second floor, the fourth floor and the fifth floor are respectively cancelled.

The hall call registration circuit 18 is disposed in the group supervision device 6, and registers or cancels the hall calls (up calls, down calls and destination calls) in accordance with the manipulations of the hall control panels 1P–5P of the respective floors.

The assignment circuit 19 similarly disposed is a well-known assignment circuit which selects the best cage to serve the hall call and assigns it. By way of example, this circuit predictively calculates periods of time required for the cages to respond to the hall calls of the respective floors, and the cage adapted to minimize the periods of time is allotted.

Cage call registration circuits 20A and 20B are respectively disposed in the cage control devices 9A and 9B. Well-known operation control circuits 21A and 21B similarly disposed control the basic operations such as the operations of opening and closing the doors of the cages, in addition to the determination of the running or stoppage and the running directions of the cages in order to cause the respective cages No. 1 and No. 2 to respond to the calls.

Figure 5:
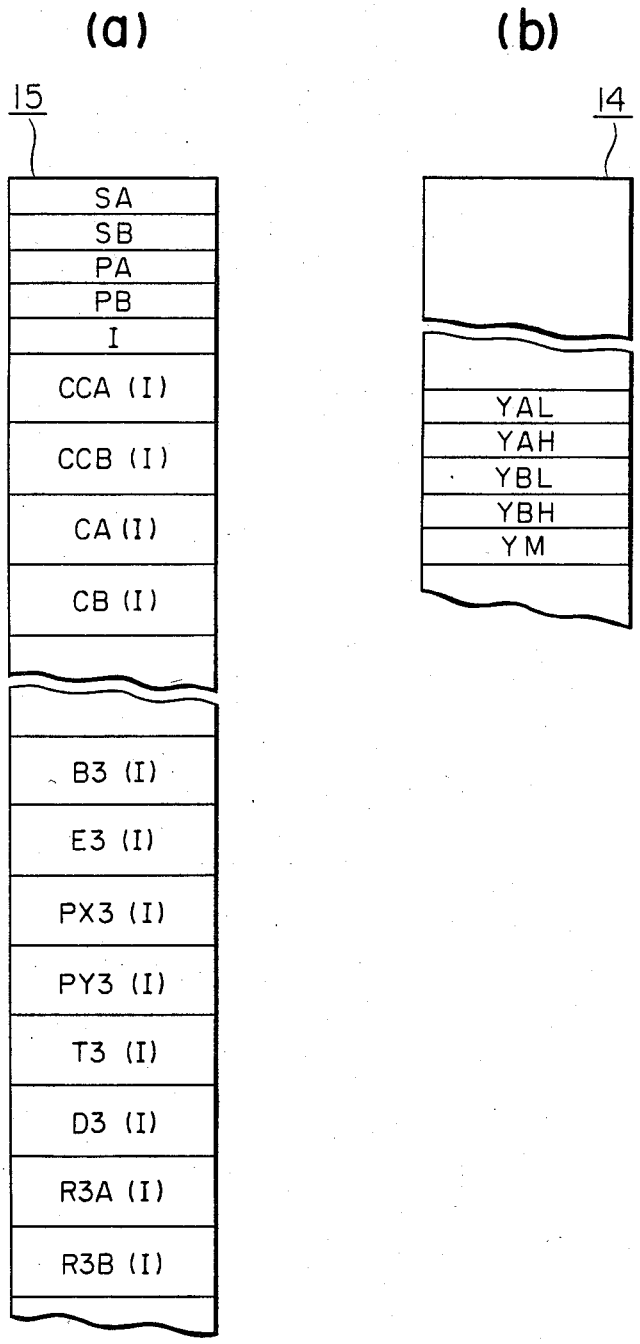
FIG. 5(*a*) is a diagram showing the memory map of a RAM included in a group supervision device in the elevator operating apparatus, while FIG. 5(*b*) is a diagram showing the memory map of a ROM included in the group supervision device.

FIGS. 5(*a*) and 5(*b*) are diagrams showing memory maps in the RAM 15 and the ROM 14, respectively. In FIG. 5(*a*), symbols SA and SB denote at-stop data items which become "1" when the respective cages No. 1 and No. 2 are at a stop, and symbols PA and PB denote cage position data items which express the cage position floors (=1–5) of the respective cages No. 1 and No. 2.

Symbol CCA(I) (I=1, 2, 3, 4, 5) denotes cage call data items which become "1" when the cage calls of the cage No. 1 for the first floor–fifth floor have been registered, while symbol CCB(I) (I=1, 2, 3, 4, 5) denotes similar cage call data items concerning the cage No. 2.

Letter I indicates a variable corresponding to any of the destination buttons of the hall control panels 1P–5P. By way of example, at the third floor, I=1, corresponds to the destination button 31B destined for the first floor, I=2 the destination button 32B destined for the second floor, I=4 the destination button 34B destined for the fourth floor, and I=5 the destination button 35B destined for the fifth floor.

Although a destination button corresponding to I=3 does not exist in the hall control panel 3P of the third floor, apparently the operation is handled as if the destination button destined for the third floor existed.

Destination button data items B3(I) (I=1, 2, 4, 5) become "1" when the destination buttons 31B, 32B, 34B and 35B of the hall control panel 3P of the third floor have been depressed, respectively. Destination call data items E3(I) (I=1, 2, 4, 5) become "1" when the destination calls of the third floor destined for the first floor, second floor, fourth floor and fifth floor have been registered, respectively.

Symbol PX3(I) (I=1, 2, 4, 5) denotes the X-coordinate data items of the waiting passenger positions P received from the dynamic displacement measuring instruments 31Z, 32Z, 34Z and 35Z for the third floor, while symbol PY3(I) (I=1, 2, 4, 5) denotes the Y-coordinate data items of the same.

Automatic tracking command data items T3(I) (I32 1, 2, 4, 5) become "1" when the commands of automatic tracking are respectively given to the dynamic displacement measuring instruments 31Z, 32Z, 34Z and 35Z for the third floor, and become "0" when the automatic tracking is ended.

Destination call cancelling command data items D3(I) (I=1, 2, 4, 5) become "1" when the destination calls of the third floor destined for the first floor, second floor, fourth floor and fifth floor are cancelled, respectively.

Symbol R3A(I) (I=1, 2, 4, 5) denotes cage call registering command data items which become "1" when the cage No. 1 is commanded to register the destination calls of the third floor for the first floor, second floor, fourth floor and fifth floor as the cage calls respectively, while symbol R3B(I) (I=1, 2, 4, 5) denotes similar cage call registering command data items concerning the cage No. 2.

Although not shown in the figure, data items for the first floor, second floor, fourth floor and fifth floor corresponding to the various data items B3(I), E3(I), PX3(I), PY3(I), T3(I), D3(I), R3A(I) and R3B(I) for the thrd floor are also set in the RAM 15.

Symbol CA(I) (I=1, 2, 3, 4, 5) denotes cage call registering command data items for outputting which become "1" when the cage No. 1 is commanded to register the cage calls of the first floor-fifth floor respectively, while symbol CB(I) (I=1, 2, 3, 4, 5) denotes similar cage call registering command data items for outputting concerning the cage No. 2.

Meanwhile, symbols YAL and YAH in the ROM 14 indicated in FIG. 5(*b*) denote fixed data items which express the Y-coordinates of the positions of the door of the cage No. 1 and which are respectively set at '100' and '300'. Likewise, symbols YBL and YBH denote fixed data items which expresss the Y-coordinates of the positions of the door of the cage No. 2 and which are respectively set at '400' and '600'. Symbol YM denotes fixed data which expresses the Y-coordinate of the position of the boundary of the elevator hall on the side of the cage No. 2, and which is set at '700'.

Figure 6:
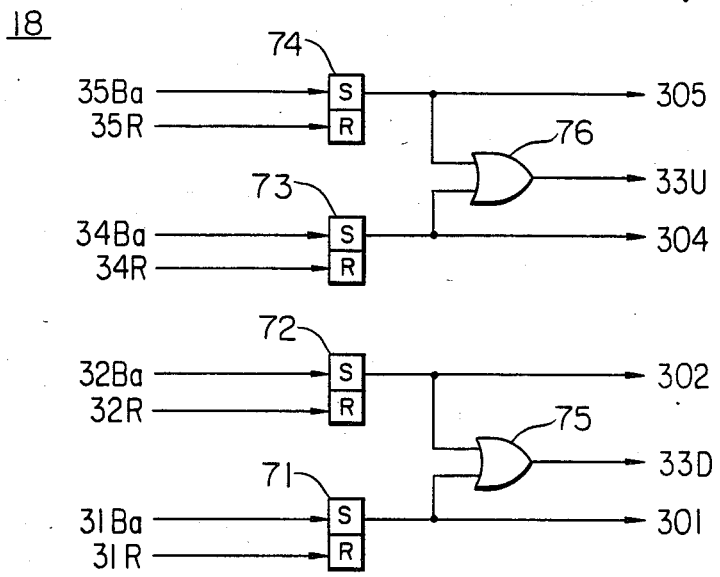
FIG. 6 is a circuit diagram of a hall call registration circuit in the group supervision device.

FIG. 6 is a circuit diagram of the hall call registration circuit 18 corresponding to the third floor. In the figure, numerals 301, 302, 304 and 305 designate destination call signals which become "H" when the destination calls of the third floor destined for the first floor, second floor, fourth floor and fifth floor have been registered, respectively.

Symbols 33U and 33D denote an up call signal and a down call signal which become "H" when the up call and down call of the third floor have been registered, respectively.

Symbols 31B*a*, 32B*a*, 34B*a* and 35B*a* denote destination button signals which become "H" when the destination buttons 31B, 32B, 34B and 35B of the third floor destined for the first floor, second floor, fourth floor and fifth floor have been depressed, respectively.

Shown at numerals 71–74 are memories each of which is constructed of a flip-flop. When the points S of the respective memories are supplied with the destination button signals 31B*a*, 32B*a*, 34B*a* and 35B*a* of "H", the contents of the memories are set to "H". When the points R of the respective memories are supplied with the destination call cancelling command signals 31R, 32R, 34R and 35R of "H", the contents of the memories are reset to "L" even if the signals of "H" are input to the points S.

Output signals from the points S of the memories 71 and 72 are passed through an OR gate 75 and are provided as the down call signals 33D, while output signals from the points S of the memories 73 and 74 are passed through an OR gate 76 and are provided as the up call signals 33U. The hall call registration circuits 18 of the other floors are similarly arranged.

Figure 7:
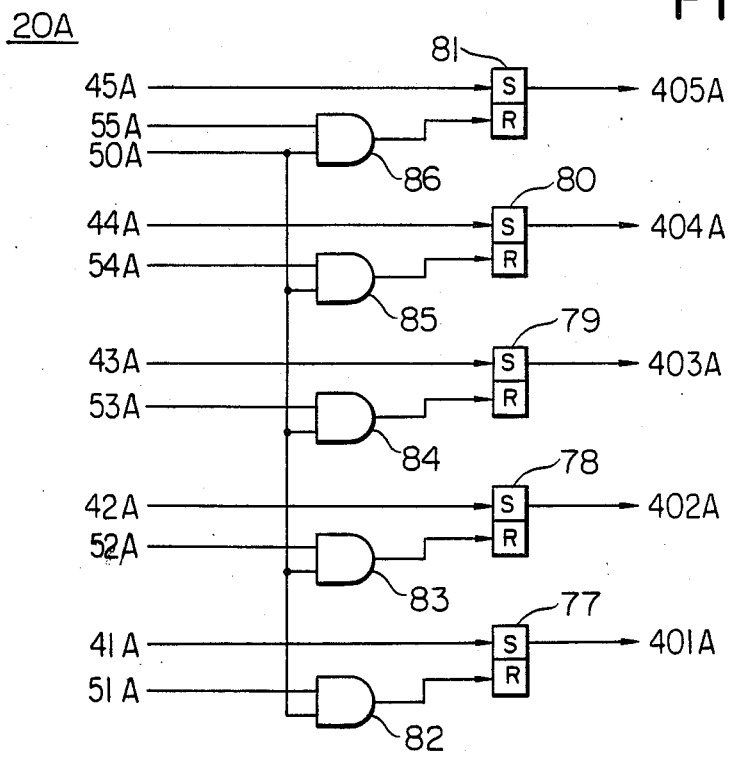
FIG. 7 is a circuit diagram of a cage call registration circuit for cage No. 1 in the elevator operating apparatus.

FIG. 7 shows the cage call registration circuit 20A of the cage No. 1. In the figure, symbols 401A–405A denote cage call signals which become "H" when the cage calls of the first floor–fifth floor have been registered in the cage No. 1.

Cage position signals 51A–55A become "H" when the cage No. 1 lies at the first floor–fifth floor, respectively. An at-stop signal 50A becomes "H" when the cage No. 1 is at a stop at the hall of any floor. These signals are set by the operation control circuit 21A of the cage control device 9A.

The corresponding one of the cage position signals 51A–55A is applied to one input terminal of the corresponding one of AND gates 82–86, and the at-stop signal 50A is applied to the other input terminals of the AND gates 82–86 in common. Outputs from the AND gates 82–86 are applied to the points R of memories 77–81.

The at-stop signal 50A becomes "H" when the cage No. 1 is at a stop at the hall of any floor. It is set by the operation control circuit 21A of the cage control device 9A.

The memories 77–81 are similar to those 71–74 in FIG. 6, and the respective points S thereof are supplied with cage call registering command signals 41A–45A. The cage call registration circuit 20B of the cage No. 2 is similarly arranged.

Figure 8:
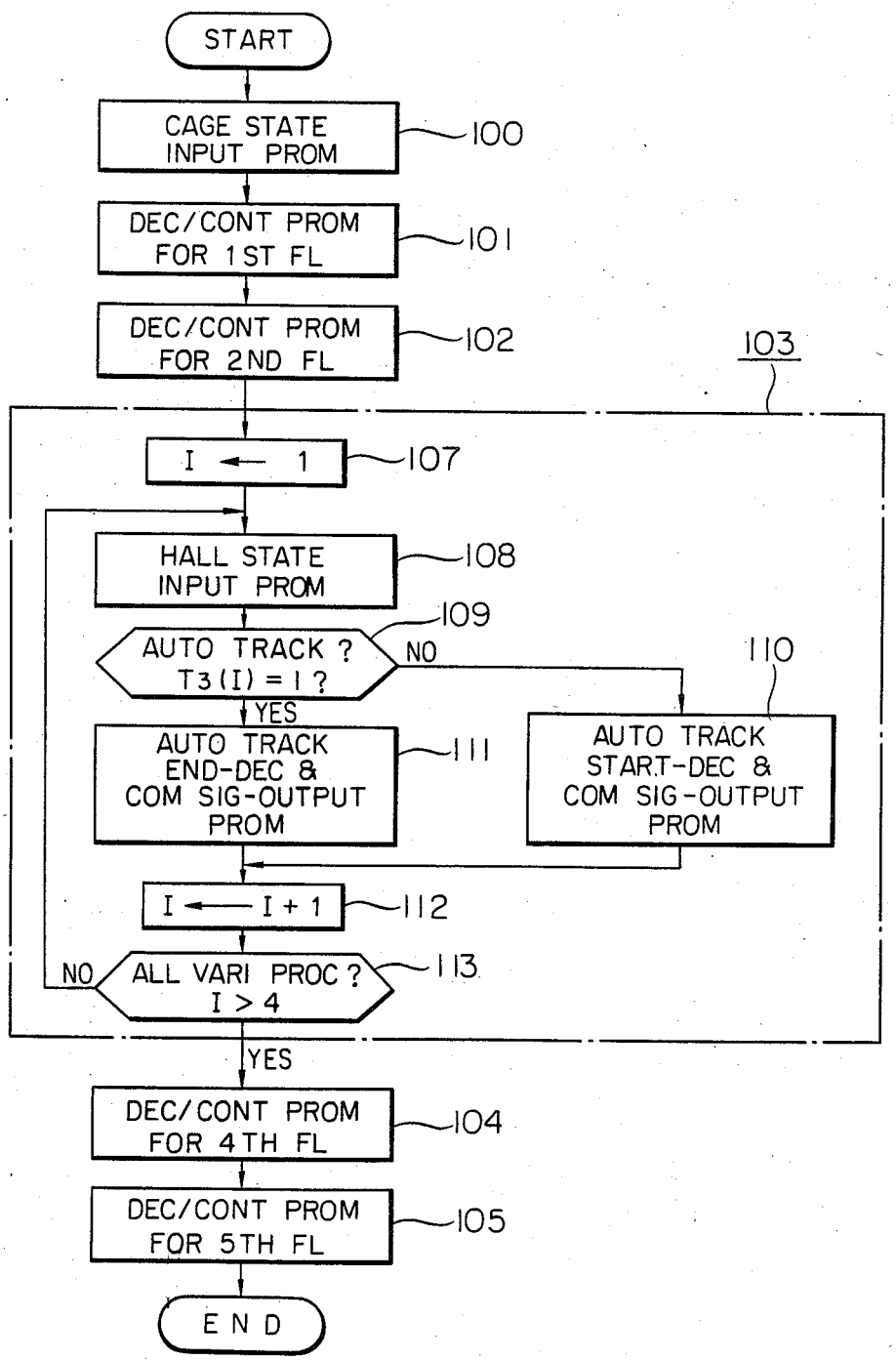
FIG. 8 is a flow chart showing the general operating flow of a decision program stored in the aforementioned ROM.
Figure 10:
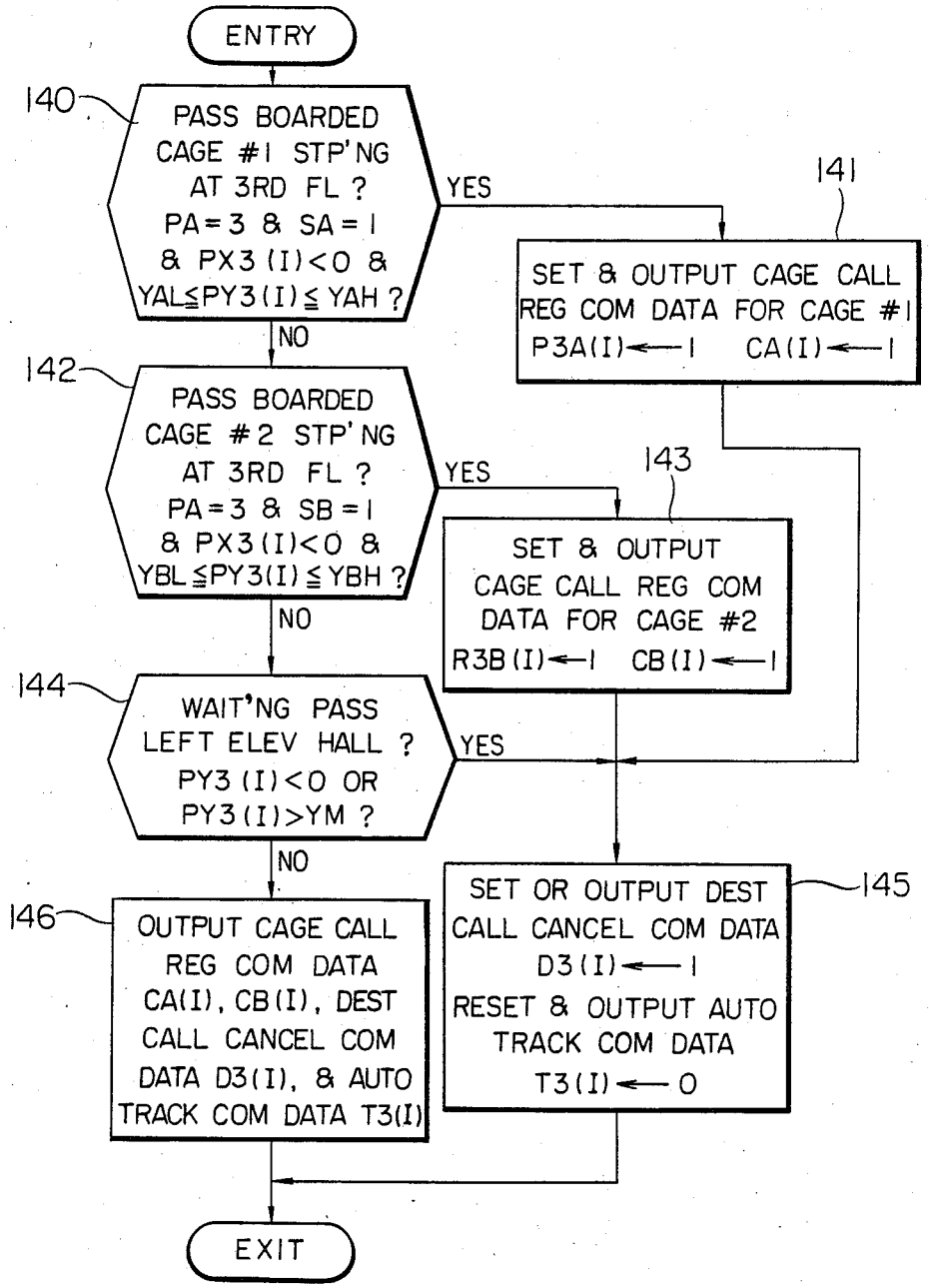

FIG. 8 is a flow chart showing the whole decision program stored in the ROM 14 of the passenger action deciding device 12, and FIGS. 9 and 10 are flow charts showing subprograms in FIG. 8.

Next, the operation of the embodiment will be described with reference to FIGS. 1–10. The decision program of the passenger action deciding device 12 shown in FIG. 8 is executed every 0.1 second in accordance with steps 101–105.

In the cage state input program of a step 100, signals are input from the cage control devices 9A and 9B through the input circuit 16, to set the at-stop data SA and SB, the cage position data PA and PB, and the cage cell data CCA(1)–CCA(5) and CCB(1)–CCB(5). In addition, the cage call registration command data items for outputting, CA(1)–CA(5) and CB(1)–CB(5) are all initialized to "0".

Subsequently, in the respective decision and control programs of the steps 101–105, the operations of tracking the actions of waiting passengers at the first floor–fifth floor are respectively controlled, and the contents of the actions are decided so as to control the elevator operations (the registration and cancellation of the calls) in accordance with the decisions. These circumstances will be explained along the steps 107–113 of the decision/control program 103 for the third floor.

First, at the step 107, the variable I corresponding to the hall destination buttons 31B, 32B, 34B and 35B of the third floor is initialized to "1".

Next, at the step 108, signals are applied through the input circuit 16 from the destination button indicated by the variable I, the dynamic displacement measuring instrument corresponding thereto and the hall call registration circuit 18, to set the destination button data B(I), the waiting passenger position data PX3(I), PY3(I) and the destination call data E3(I) (the data items corresponding to I=3 are all set to "0").

Subsequently, the step 109 decides whether or not the dynamic displacement measuring instrument corresponding to the variable I is automatically tracking the waiting passenger who has depressed the destination button corresponding to the variable I. If the instrument is not automatically tracking the waiting passenger, the automatic tracking command data T3(I) is "0", and hence, the control flow proceeds to the step 110.

The step 110 decides whether or not the automatic tracking of the action of the waiting passenger is to be started, and whether or not the command signal concerning the call registration is to be reset. Now, this step will be described in detail with reference to FIG. 9.

A step 120 in FIG. 9 decides whether or not a destination call corresponding to the variable I has been registered. Before the destination call is registered, the destination call data E3(I) is "0", and hence, the control flow proceeds to a step 121. Here, the destination call cancelling command data D3(I) is reset to "0", and among the destination call cancelling command signals 31R, 32R, 34R and 35R, the corresponding signal is delivered as "L" to the hall call registration circuit 18 through the output circuit 17.

If the destination call has been registered, the control flow proceeds to a step 122, which delivers the destination call cancelling command data D3(I) as it is.

Next, a step 123 decides whether or not the destination button corresponding to the variable I has been depressed. If the destination button corresponding to the variable I has not been depressed at the third floor, the destination button data B3(I) is "0". Therefore, the control flow proceeds to a step 125, which outputs the automatic tracking command data T3(I) as it is.

However, assuming by way of example that I=4 hold, in other words, that a passenger destined for the fourth floor have entered the elevator hall and have depressed the destination button 34B for the fourth floor in front of the hall control panel 3P, the destination button signal 34B*a* becomes "H", so that the destination button data B3(4) is set to "1".

On this occasion, accordingly, the control flow proceeds from the step 123 to a step 124, at which the automatic tracking command data T3(I) is set to "1", and the automatic tracking command signal 64Z is delivered as "H" through the output circuit 17.

Thus, the dynamic displacement measuring instrument 34Z begins to automatically track the action of the waiting passenger (=destined for the fourth floor) within the window having been set in front of the hall control panel 3P.

Meanwhile, when the destination button 34B has been depressed, the destination button signal 34B*a* becomes "H" in the hall call registration circuit 18 in FIG. 6 (at this time, the destination call cancelling command signal 34R is of "L"). Therefore, the content of the memory 73 is set to "H", whereby the signal 304 of the destination call destined for the fourth floor becomes "H" and also the up call signal 33U of the third floor becomes "H" through the OR gate 76. In the assignment circuit 19, the up call 33U of the third floor is allotted to the cage, e.g., No. 1 predicted to be quickly responsive.

Subsequently, steps 126–128 decide whether or not the cage call registering command data R3A(I) for the cage No. 1 is reset, and steps 129–131 decide whether or not the cage call registering command data R3B(I) for the cage No. 2 is reset.

In this case, as will be described later, when it has been detected that the passenger having depressed the destination button corresponding to the variable I has gotten in the cage, the cage call registering command data items R3A(I) and R3B(I) are respectively set to "1". Further, the cage call registering command data items for outputting, CA(1)–CA(5) and CB(1)–CB(5) are generated on the basis of the above data items set to "1" and are delivered to the cage call registration circuits 20A and 20B.

Thus, once the cage calls have been registered according to these commands, the functions of the cage cell registering command data items R3A(I) and R3B(I) end.

This will be explained as to the cage No. 1. At a step 126, if the cage No. 1 is a stop at the third floor and in spite of the command of registering a cage call, the corresponding cage call has not been registered yet, then the cage position data PA="3", the at-stop data SA="1", the cage call registering command data R3A-(I)="1" and the cage call data CCA(I)="0" hold. The control flow therefore proceeds to a step 128, at which the cage call registration command data R3A(I) is held intact at "1", and further, the outputting cage call registration command data CA(I) is set to "1" and is delivered to the cage call registration circuit 20A of the cage No. 1 through the output circuit 17.

When the cage No. 1 lies at any floor other than the third floor (PA≠"3"), or when it lies at the third floor but is in any state (for example, a decelerating state) other than the stopped state (SA="0"), or when it is at a stop at the third floor but has already had the corresponding cage call registered (CCA(I)=1), the control flow proceeds to a step 127. Here, the cage call registration command data R3A(I) of the cage No. 1 is reset to "0", and the outputting cage call registration command data CA(I) at that time as left intact is delivered to the cage call registration circuit 20A of the cage No. 1 through the output circuit 17.

As regards the cage No. 2, the decision of the resetting of the cage call registration command data R3B(I) and the outputting of the cage call registration command are similarly carried out by steps 129–131.

In this way, when the dynamic displacement measuring instrument corresponding to the variable I is not automatically tracking the waiting passenger, the step 110 decides whether or not the automatic tracking of the action of the waiting passenger is to be started and whether or not the command signal concerning the call registration is to be reset.

Next, assuming at the step 109 in FIG. 8 that the dynamic displacement measuring instrument corresponding to the variable I be automatically tracking the waiting passenger, the automatic tracking command data T3(I) is "1", and hence, the control flow proceeds to a step 111.

This step 111 decides whether or not the automatic tracking of the waiting passenger is to be ended and whether or not the command signal concerning the call registration is to be set. Now, this step will be described is detail with reference to FIG. 10.

A step 140 in FIG. 10 decides whether or not the waiting passenger having depressed the destination button corresponding to the variable I has gotten in the cage No. 1. Assuming that the waiting passenger having depressed the destination button corresponding to the variable I=4, namely, the waiting passenger destined for the fourth floor have gotten in the cage No. 1 at the third floor, the cage position data of the cage No. 1 and the at-stop data thereof are PA="3" and SA="1" respectively. Further, when the position data items of the waiting passenger destined for the fourth floor are assumed PX3(4)=−10 and PY3(4)=200, PX3(4)<0 and YAL(=100)<PY3(4)<YAH (=300) hold. Therefore, the control flow proceeds to a step 141.

Here, the cage call registration command data R3A(4) for the cage No. 1 is set to "1". Further, the outputting cage call registration command data CA(4) is set to "1" and is delivered to the cage call registration circuit 20A of the cage No. 1 through the output circuit 17.

On this occasion, in the cage registration circuit 20A of the cage No. 1, the cage call registration command signal 44A becomes "H". Therefore, the content of the memory 80 is set to "H", the cage call signal 404A of the fourth floor becomes "H" and the cage call of the fourth floor is registered in the cage No. 1.

When the step 141 is followed by a step 145, the cancellation command data D3(4) for the destination call destined for the fourth floor is set to "1" and the destination call cancelling command signal 34R is delivered as "H" to the hall call registration circuit 18 through the output circuit 17.

On this occasion, in the hall call registration circuit 18, the content of the memory 73 is reset to "L", and the destination call signal 304 for the fourth floor is reset to "L". If, at this time, the destination call 305 for the fifth floor has not been registered, the up call signal 33U of the third floor is also reset to "L".

Besides, at the step 145, the automatic tracking command data T3(4) is reset to "0", the automatic tracking command signal 64Z is delivered as "L" to the dynamic displacement measuring instrument 34Z through the output circuit 17, and the position signal 34Z*a* of the waiting passenger returns to the measurement starting point ($X_0$, $Y_0$) and the window is set at the initial position accordingly.

Circumstances are similar in a case where the waiting passenger having depressed the destination button corresponding to the variable I=1, 2 or 5 has gotten in the cage No. 1. The cage call registering command data R3A(I) and the destination call cancelling command data D3(I) are respectively set to "1", the automatic tracking command data T3(I) is reset to "0", and the corresponding signals are delivered.

In a case where the waiting passenger having depressed the destination button corresponding to the variable I has gotten in the cage No. 2, not in the cage No. 1, the control flow proceeds from the step 141 to a step 142 and then to a step 143, at which the cage call registration command data R3B(I) for the cage No. 2 is set to "1" and the outputting cage call registration command data CB(I) is set to "1".

Further, at the step 145 following the step 143, as in the case of the cage No. 1, the destination call cancelling command data D3(I) is set to "1", the automatic tracking command data T3(I) is reset to "0" and the corresponding signals are delivered.

When it has not been decided that the waiting passenger having depressed the destination button corresponding to the variable I has gotten in the cage No. 1 or the cage No. 2, the control flow proceeds along the step 140–the step 142–a step 144, which decides whether or not the waiting passenger has egressed from the elevator hall.

Assuming that at the third floor, the waiting passenger having depressed the destination button corresponding to the variable I=4, namely, the waiting passenger destined for the fourth floor have egressed from the elevator hall through the elevator hall doorway on the cage No. 1 side and that the position data items of the waiting passenger become PX3(4)=200 and PY3(4)=−10, then PY3(3) holds, and hence, the control flow proceeds to the step 145. Here, the cancellation command data D3(4) for the destination call destined for the fourth floor is set to "1" and is delivered. Eventually, the destination call signal 304 for the fourth floor is reset to "L".

At this time, if the destination call 305 for the fifth floor has not been registered, the up call 33U of the third floor is also reset to "L".

Further, at the step 145, the automatic tracking command data T3(4) is reset to "0" and is delivered. Eventually, the automatic tracking of the dynamic displacement measuring instrument 34Z ends.

Circumstances are similar in a case where the waiting passenger has egressed through the elevator hall doorway on the cage No. 2 side (PY3(I)>YM). Further, circumstances are similar in cases of the other variable values, I=1, 2 and 5.

In a case where the waiting passenger having depressed the destination button corresponding to the variable I is awaiting the arrival of the cage in the elevator hall of the third floor, the control flow proceeds along the step 140–the step 142–the step 144–a step 146. Here, the outputting cage call registration command data CA(I), CB(I), destination call cancellation command data D3(I) and automatic tracking command data T3(I) which are stored in the RAM 15 are delivered to the hall call registration circuit 18 and the dynamic displacement measuring instruments 31Z, 32Z, 34Z and 35Z through the output circuit 17 as they are.

When the dynamic displacement measuring instrument corresponding to the variable I is automatically tracking the waiting passenger in this manner, the step 111 decides whether or not the automatic tracking of the waiting passenger is to be ended and whether or not the command signal concerning the call registration is to be set.

When the process of the step 110 or the step 111 in FIG. 8 has ended, the step 112 counts up the variable I by "1" and the step 113 decides whether or not the processes of the steps 108–111 have ended as to all the variable values I=1, 2, 3, 4 and 5.

If the processes have not ended, the control flow returns to the step 108 again, whereupon the same steps 108–113 are repeated for a new variable value I. When the processes have ended for all the variable values I, the process of the decision and control program 103 for the third floor ends.

In order to facilitate the formation of the program, the steps 108–113 are wastefully operated even in the case where neither of the corresponding destination button and dynamic displacement measuring instrument exists (the case of I=3). However, no problem is posed because at the step 108, all the items of the destination button data B(I), waiting passenger position data PX3(I), PY3(I) and destination call data E3(I) are set to "0" beforehand, and also at the step 100, the items of the outputting cage call registration data CA(I), CB(I) are set to "0".

The decision and control programs 101, 102, 104 and 105 for the other floors, namely, for the first floor, second floor, fourth floor and fifth floor respectively are formed similarly to the decision and control program for the third floor, and function similarly.

The cage call registered as described above is cancelled in the following way. For example, in a case where the cage call of the cage No. 1 for the fourth floor has been registered; when the cage No. 1 has arrived and stopped at the fourth floor, the fourth-floor cage position signal 54A becomes "H" and the at-stop signal 50A becomes "H" in the cage call registration circuit 20A in FIG. 7. Therefore, the output of the AND gate 85 becomes "H", the content of the memory 80 is reset to "L" and the fourth-floor cage call signal 404A becomes "L", so that the cage call for the fourth floor is cancelled. Circumstances are similar as to the cage calls for the other floors and the cage calls of the cage No. 2.

In this manner, in the embodiment, the action of a waiting passenger who has depressed the destination button of a hall control panel installed in the hall of each floor is tracked, and when it has been detected that the passenger has gotten in a cage, a destination call appointed by the passenger is registered in the cage as a cage call, while at the same time, the registration of the destination call is cancelled.

Further, when it has been detected that the waiting passenger has egressed from the elevator hall without getting in a cage, the registration of the destination call appointed by the waiting passenger is cancelled, upon deeming that the waiting passenger no longer needs to utilize the elevator for any reason.

Accordingly, the wasteful calling of a cage and the wasteful registration of a cage call are avoided, and the operating efficiency of the elevator can be enhanced.

Besides, in the embodiment, a destination call made by a waiting passenger other than the waiting passenger who has gotten in the cage is not cancelled even upon the arrival of the cage, unless the other waiting passenger gets in the cage. Therefore, in a case where the other waiting passenger could not get in the cage on account of the full capacity or the like, he/she can be saved from the trouble of appointing a destination floor again.

While, in the embodiment, the destination buttons disposed in the hall correspond to the respective floors in one-to-one fashion, the way of disposing the destination buttons is not restricted thereto. For example, as described in the specification of Japanese Utility Model Registration Application No. 58-191194, it is also easy that in a department store, a hotel or the like, destination buttons are disposed for the respective desired places (such as salesrooms or guest rooms) of waiting passengers, whereupon cage calls are registered with the destination buttons corresponding to floors at which the desired places exist.

In this case, the actions of waiting passengers can be tracked for the respective desired places. Therefore, even when at least two waiting passengers whose destination floors are the same but whose desired places are different have gotten in individual cages, there is not involved the inconvenience that the cage call of the destination floor of either passenger is not registered in the cage in which this passenger has gotten.

In addition, means for appointing the destination floors or desired places is not restricted to the destination buttons, but it may well utilize voice, ten-key, magnetic cards for identifying persons, etc.

Further, regarding the measuring instrument for tracking the action of a waiting passenger, the input signal thereof is the image of the television camera in the foregoing embodiment, but the former is not restricted to the latter. By way of example, an object to be handled may well be tracked on the basis of an input signal from an infrared camera or based on an ultrasonic oscillator and receiver, or a specified signal (e.g., electric wave) produced from the waiting passenger and received by a receiver may well be used as the input signal for the tracking.

Moreover, while the embodiment has referred to the elevator in which no destination buttons are provided in the cages, it is to be understood that this invention is also applicable to an elevator in which destination buttons are provided in both the halls and the cages. The number of cages is not restricted to two, but the invention is readily applied to an elevator including a single cage or at least three cages.

The embodiment is so constructed that when a waiting passenger has gotten in a cage having arrived, the cage call of his/her destination floor is registered. However, the operating apparatus of the invention is readily constructed so that before a cage arrives, for example, when a cage has been assigned to a destination call, the corresponding cage call is registered in advance, and that the cage call is held registered if a waiting passenger gets in the assigned cage upon the arrival of this cage at the hall of the passenger, whereas the cage call is cancelled if not.

As described above, in an operating apparatus for an elevator wherein the halls of the floors of a building are furnished with destination buttons for appointing the floors or the specified places thereof and wherein the destination button is depressed to register hall calls consisting of a call for calling a cage and a destination call for appointing a destination floor and also to register the cage call of the appointed destination floor, so as to cause the cage to respond to the hall calls and the cage call, this invention consists in that the action of a waiting passenger having depressed the destination button is tracked by measurement means and is decided by decision/control means in accordance with the output of the measurement means so as to give the command of registering or cancelling the calls. Therefore, the wasteful stops of the cage can be reduced.

What is claimed is:

1. In an elevator having hall control panels installed in halls of a plurality of floors and having destination buttons, hall call registration means provided on said hall control panels for registering calls corresponding to destination floors requested by waiting passengers, cage call registration means for registering cage calls corresponding to the destination floors, and operation control means responsive to the hall calls and the cage calls for assigning a cage to serve the requested destination floors, an operating apparatus for controlling operation of the elevator comprising measurement means for tracking movement of the waiting passengers and for generating outputs representative thereof, and decision/control means responsive to the outputs of said measurement means for determining the destination floors to be serviced by said cage by the calls requested by the passengers.

2. An operating apparatus for an elevator according to claim 1 wherein, when the outputs of said measurement means indicate that the waiting passengers have gotten into the assigned cage, said decision/control means registers as the cage calls the halls corresponding to the destination floors requested by the waiting passengers.

3. An operating apparatus for an elevator according to claim 1 wherein, when the outputs of said measurement means indicate that one of the waiting passengers has gotten into the assigned cage, said decision/control means registers as the cage call the hall call corresponding to the destination floor requested by the waiting passenger getting on and cancels the hall calls requested by other waiting passengers who have not gotten into the assigned cage.

4. An operating apparatus for an elevator according to claim 1 wherein said measurement means comprises television camera means for generating an image for each of the passengers waiting in the hall, and dynamic displacement measurement means for analyzing the images generated from said television camera means so as to track the movement of the waiting passengers and to detect positions thereof.

5. An operating apparatus for an elevator according to claim 4 wherein said television camera means is installed in a ceiling of the hall so as to generate the images of the waiting passengers from above.

6. An operating apparatus for an elevator according to claim 4 wherein said television camera means provides a darkest spot in each image of a waiting passenger, and said dynamic displacement measurement means detects and tracks the movement of the darkest spots so as to detect the positions of the waiting passengers.

7. An operating apparatus for an elevator according to claim 6 wherein said dynamic displacement measurement means sets a window of predetermined size around each of the darkest spots such that there are not overlapping spots therebetween and that movement of one darkest spot corresponding to the position of a passenger can be tracked without being affected by another dark spot corresponding to the position of another waiting passenger.

8. An operating apparatus for an elevator according to claim 1 wherein said measurement means provides a reference measurement operation starting point at a place where said hall control panels are located.

9. An operating apparatus for an elevator according to claim 1 wherein, when said measurement means has erroneously missed an image of a waiting passenger, an output is produced corresponding to positional data of the waiting passenger immediately before the missing image.

10. A operating apparatus for an elevator according to claim 1 wherein, when the hall calls are registered on said hall control panels, said measurement means is immediately activated to start tracking the movement of the waiting passengers in the hall.

11. An operating apparatus for an elevator according to claim 1 wherein said measurement means tracks the movement of the waiting passengers on an individual basis and said decision/control means determines the destination floors to be serviced by individually selecting between registering and cancelling the calls which correspond to the respective waiting passengers.

12. An operating apparatus for an elevator according to claim 1 wherein said decision/control means cancels the hall calls corresponding to the destination floors requested by the waiting passengers when the requested hall calls have already been registered in the assigned cage.

13. In an elevator having hall control panels installed in halls of a plurality of floors and including hall buttons, hall call registration means provided on said hall control panels for registering hall calls corresponding to destination floors requested by waiting passengers, cage call registration means for registering cage calls corresponding to desired destination floors, and operation control means responsive to the hall calls and the cage calls for assigning a cage to serve the requested destination floors, an operating apparatus for controlling operations of the elevator comprising measurement means for tracking movement of the waiting passengers and for generating outputs representative thereof, and decision/control means responsive to the outputs of said measurement means for determining whether or not the waiting passengers have egressed from the elevator hall and for cancelling the registration of the hall calls requested by the waiting passengers under at least a condition that the waiting passengers have egressed from the elevator hall.

14. An operating apparatus for an elevator according to claim 13 wherein the hall buttons of said hall control panels are destination buttons for designating floors to be served.

15. An operating apparatus for an elevator according to claim 13 wherein the hall buttons of said hall control panels include up buttons and down buttons for requesting a cage to move in an up direction and a down direction, respectively.

16. An operating apparatus for an elevator according to claim 15, wherein said hall call registration means registers up calls and down calls in response to the depressions of the up buttons and the down buttons, respectively.

17. An operating apparatus for an elevator according to claim 13 wherein said cage call registration means registers the cage calls corresponding to the desired floors in response to the depressions of destination buttons disposed in the cage.

18. An operating apparatus for an elevator according to claim 14 wherein said measurement means tracks movement of individual passengers waiting in the hall and having depressed the destination buttons.

19. An operating apparatus for an elevator according to claim 15 wherein said measurement means tracks movement of the individual passengers waiting in the hall and having depressed the up buttons and the down buttons.

20. An operating apparatus for an elevator according to claim 16 wherein said decision/control means cancels the registration of the up calls or down calls based on the up buttons or down buttons depressed by the waiting passengers under at least the condition that the waiting passengers have egressed from the elevator hall.

21. An operating apparatus for an elevator according to claim 13 wherein, upon detecting that the waiting passengers having depressed the hall buttons do not get in the cage, said decision/control means determines whether the waiting passengers have egressed from the elevator hall.

* * * * *